US010670042B2

(12) United States Patent
Rafalko

(10) Patent No.: US 10,670,042 B2
(45) Date of Patent: Jun. 2, 2020

(54) HUB FOR A FLUID-FLOW CONTROL SYSTEM

(71) Applicant: Deere & Company, Moline, IL (US)

(72) Inventor: Eric Rafalko, Winston-Salem, NC (US)

(73) Assignee: Deere & Company, Moline, IL (US)

( * ) Notice: Subject to any disclaimer, the term of this patent is extended or adjusted under 35 U.S.C. 154(b) by 128 days.

(21) Appl. No.: 15/728,582

(22) Filed: Oct. 10, 2017

(65) Prior Publication Data

US 2019/0107117 A1 Apr. 11, 2019

(51) Int. Cl.

| | |
|---|---|
| ***F04D 29/32*** | (2006.01) |
| ***F01P 5/02*** | (2006.01) |
| ***F04D 29/26*** | (2006.01) |
| *F04D 29/64* | (2006.01) |
| *F04D 29/34* | (2006.01) |
| *F01P 5/06* | (2006.01) |

(52) U.S. Cl.

CPC ..... *F04D 29/329* (2013.01); *F01P 5/02* (2013.01); *F04D 29/263* (2013.01); *F01P 5/06* (2013.01); *F04D 29/34* (2013.01); *F04D 29/646* (2013.01)

(58) Field of Classification Search

CPC ..... F04D 29/329; F04D 29/263; F04D 29/34; F04D 29/646; F04D 25/0613; F01P 5/06; F01P 5/02

See application file for complete search history.

(56) References Cited

U.S. PATENT DOCUMENTS

| | | | | |
|---|---|---|---|---|
| 4,180,024 | A * | 12/1979 | Hernandez | F01P 5/02 123/41.46 |
| 2002/0047384 | A1* | 4/2002 | Matsumoto | F04D 25/0613 310/89 |
| 2003/0180165 | A1* | 9/2003 | Motomura | F04D 29/263 417/423.12 |
| 2003/0184168 | A1* | 10/2003 | Matsumoto | F04D 25/0613 310/66 |
| 2004/0191088 | A1* | 9/2004 | Matsumoto | F04D 25/0613 417/354 |
| 2012/0183417 | A1* | 7/2012 | Linnenbrock | F04D 29/263 417/410.1 |
| 2012/0224988 | A1* | 9/2012 | Maier | F04D 25/08 417/423.1 |
| 2013/0170967 | A1* | 7/2013 | Chou | F04D 25/0613 415/182.1 |

(Continued)

*Primary Examiner* — Ninh H. Nguyen
*Assistant Examiner* — Behnoush Haghighian
(74) *Attorney, Agent, or Firm* — Kilpatrick Townsend & Stockton LLP

(57) ABSTRACT

A hub for a fluid-flow control system of a vehicle can include an interface surface configured to be positioned adjacent to a corresponding interface surface of the fluid-flow control system. The interface surface can have at least two openings positioned to align with at least two corresponding openings in the corresponding interface surface of the fluid-flow control system and through which mounting components are receivable for coupling the hub to the fluid-flow control system. The hub can also include a raised surface protruding from the interface surface and having a diameter that is smaller than another diameter of the interface surface. The raised surface can have a profile with at least two keys configured to be received in corresponding keyholes of the corresponding interface surface of the fluid-flow control system.

20 Claims, 10 Drawing Sheets

(56) References Cited

U.S. PATENT DOCUMENTS

| | | | | |
|---|---|---|---|---|
| 2013/0336792 | A1* | 12/2013 | Hsu | F04D 25/064<br>416/174 |
| 2015/0204351 | A1* | 7/2015 | Watanabe | F04D 29/329<br>415/213.1 |
| 2016/0186771 | A1* | 6/2016 | Evers | H02K 9/06<br>416/90 R |
| 2017/0130724 | A1* | 5/2017 | Bielesch | F04D 19/002 |
| 2018/0080457 | A1* | 3/2018 | Kim | F04D 25/08 |
| 2018/0119615 | A1* | 5/2018 | Scott | F04D 29/38 |

* cited by examiner

HUB FOR A FLUID-FLOW CONTROL SYSTEM

FIELD OF THE DISCLOSURE

The present disclosure relates generally to housings or mounting assemblies. More specifically, but not by way of limitation, this disclosure relates to a hub for a fluid-flow control system.

BACKGROUND

A vehicle (e.g., car, plane, truck, boat, etc.) can include a fluid-flow control system. The fluid-flow control system can direct fluid flow in a particular manner. Examples of a fluid can include a liquid or gas, such as air. The fluid-flow control system can include a fan for directing the fluid flow. In some cases, the fan can direct fluid flow in the direction that the fan is facing. For example, the fan may blow air in a forward direction if the fan is facing forwards and in a backward direction if the fan is facing backwards. In other cases, the fan can direct fluid flow in the same direction either way. For example, the fan may blow air in a forward direction, regardless of whether the fan is facing forwards or backwards. This may be due to the shape of the fan's blades.

Fans that direct fluid flow in the same direction either way may operate with higher efficiency if the fan is oriented facing one direction than if the fan is oriented facing the opposite direction. For example, the fan may blow more air in the forwards direction if the fan is facing forwards than if the fan is facing backwards. So, it may be desirable to orient the fan facing in a particular direction in a fluid-flow control system to improve the efficiency and performance of the fluid-flow control system. But such fans may be mistakenly installed backwards (e.g., facing the opposite direction), since both sides of the fan may look visually similar and the fan blows in the same direction either way.

SUMMARY

One example of the present disclosure includes a hub for a fluid-flow control system of a vehicle. The fluid-flow control system can include an interface surface configured to be positioned adjacent to a corresponding interface surface of the fluid-flow control system. The interface surface can have at least two openings positioned to align with at least two corresponding openings in the corresponding interface surface of the fluid-flow control system and through which mounting components are receivable for coupling the hub to the fluid-flow control system. The hub can also include a raised surface protruding from the interface surface and having a diameter that is smaller than another diameter of the interface surface. The raised surface can have a profile with at least two keys configured to be received in corresponding keyholes of the corresponding interface surface of the fluid-flow control system. Each opening in the at least two openings of the interface surface can have a central point that is offset from another central point of a perimeter of a corresponding key of the at least two keys.

Another example of the present disclosure includes a fan for a fluid-flow control system of a vehicle. The fan can include an interface surface configured to be positioned adjacent to a corresponding interface surface of a hub. The interface surface can have at least two openings positioned to align with at least two corresponding openings in the hub and through which mounting components are receivable for coupling the hub to the fan. The fan can include an interior cutout that has at least two keyholes configured to receive corresponding keys of the corresponding interface surface of the hub. Each opening in the at least two openings of the interface surface can have a central point that is offset from another central point of a perimeter of a corresponding keyhole of the at least two keyholes.

Another example of the present disclosure includes a method for coupling a hub to a fan. The method can include inserting a raised surface of the hub into an interior cutout of the fan such that at least two keys defined by a profile of the raised surface of the hub are received by at least two keyholes defined by the interior cutout of the fan. The method can include positioning an interface surface of the hub adjacent to another interface surface of the fan such that a first plurality of openings in the interface surface of the hub aligns with a second plurality of openings in the other interface surface of the fan. The raised surface of the hub can protrude from the interface surface of the hub and have a diameter that is smaller than another diameter of the interface surface of the hub. The method can include mounting the hub to the fan at least in part by inserting mounting components through the second plurality of openings into the first plurality of openings.

This summary is not intended to identify key or essential features of the claimed subject matter, nor is it intended to be used in isolation to determine the scope of the claimed subject matter. The subject matter should be understood by reference to appropriate portions of the entire specification, any or all drawings, and each claim.

DETAILED DESCRIPTION

Certain aspects and features of the present disclosure relate to a hub for connecting a shaft of a motor to a fan of a fluid-flow control system. The hub includes an interface surface that can be positioned adjacent to a corresponding interface surface of the fan. The interface surface of the hub can have several openings that are spatially oriented to align with openings in the corresponding interface surface of the fan if the fan is facing a desired direction, such as a forwards direction. The openings of the hub are also spatially oriented to be misaligned with the openings in the fan if the fan is facing an opposite direction, such as a backwards direction. This can enable the fan to be mounted to the hub if the fan is facing the desired direction, but prevent the fan from being mounted to the hub when the fan is facing the opposite direction. If the fan is facing the desired direction, the fan can be mounted to the hub using mounting components (e.g., screws, bolts, or nails), which can be inserted through the openings in the fan into the openings in the hub.

In some examples, the hub includes a raised surface protruding from its interface surface. The raised surface can have a profile with several keys configured (e.g., shaped, sized, oriented, or any combination of these) to be received in corresponding keyholes of the corresponding interface surface of the fan. The keys and corresponding keyholes can also be spatially arranged to enable the fan to be mounted to the hub when the fan is facing the desired direction, but to prevent the fan from being mounted to the hub when the fan is facing the opposite direction.

In some examples, the interface surface of the hub can have an axis of symmetry that is different from an axis of symmetry of the raised surface. An axis of symmetry can be an axis that divides a component in half such that one half of the component is symmetrical to the other half of the component. For example, the openings can be spatially arranged around the interface surface of the hub to create a first axis of symmetry. And the keys can be spatially arranged around the raised surface of the hub to create a second axis of symmetry that is offset from the first axis of symmetry. In some examples, configuring the interface surface and the raised surface to have different axes of symmetry can create an arrangement of the keys and openings around the hub that only enables the fan to be mounted to the hub in a desired direction.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

Figure 1:
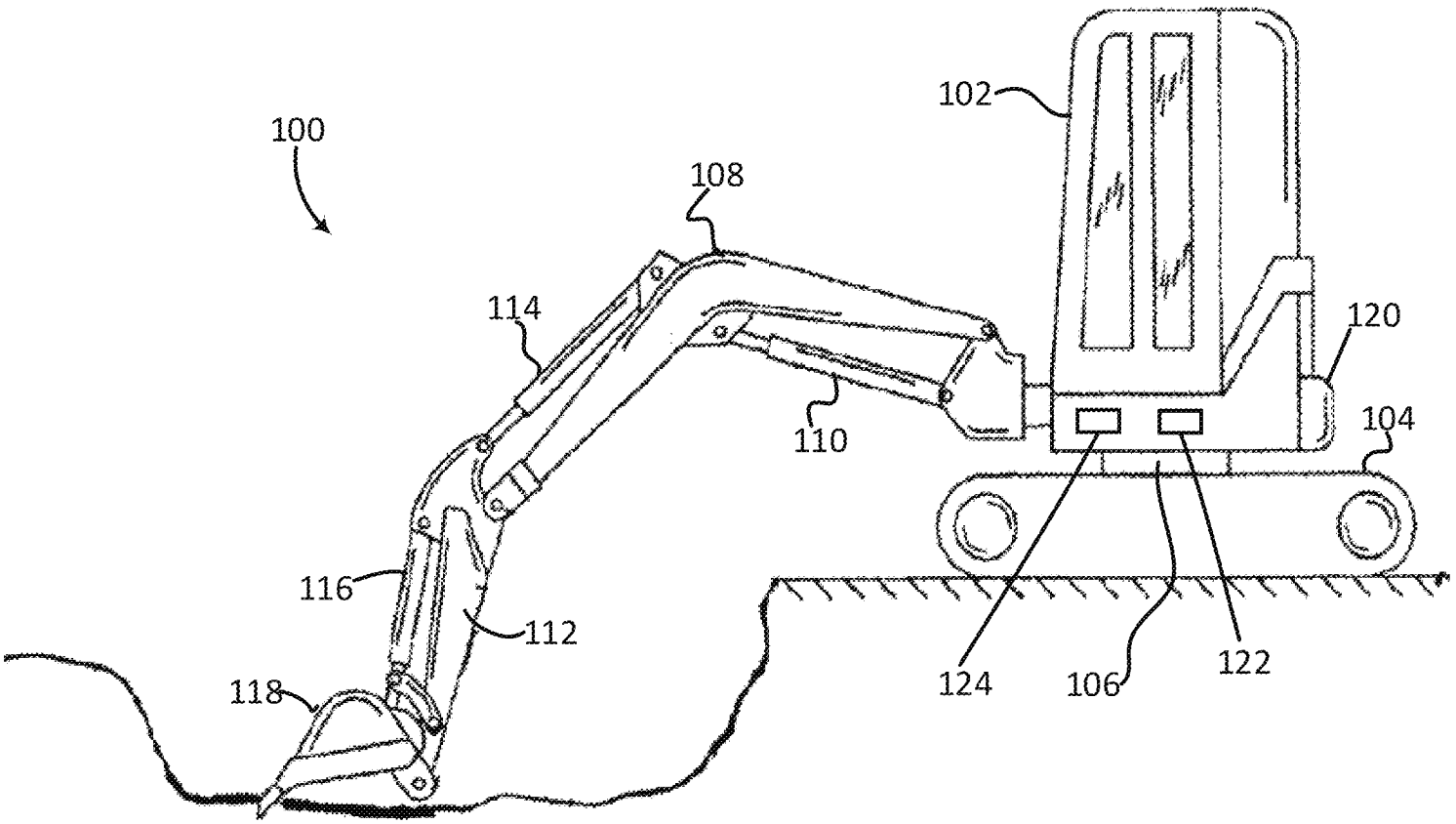
FIG. 1 is a perspective view of an example of a vehicle according to some aspects.

FIG. 1 is a perspective view of an example of a vehicle 100 according to some aspects. In this example, the vehicle 100 is an excavator. In other examples, the vehicle 100 can be another type of work vehicle, such as a truck, backhoe loader, bulldozer, harvester, or paver.

The vehicle 100 can include an interior portion 102, such as a cab. The interior portion 102 can include a control system for operating the vehicle 100. In some examples, the control system can include one or more levers, wheels, knobs, buttons, pedals, joysticks, or other input devices.

The vehicle 100 can include an undercarriage. The undercarriage can be positioned beneath the interior portion 102. The undercarriage can include a movement device 104 for providing mobility to the vehicle 100. In the example shown in FIG. 1, the movement device 104 includes a track system. The track system can include one or more tracks positioned either side of the undercarriage. In other examples, the movement device 104 can additionally or alternatively include wheels.

In some examples, the interior portion 102 can be positioned on an upper frame rotatably coupled to the undercarriage by a pivot device 106, such as a swing pivot. The pivot device 106 can allow the upper frame to rotate with respect to the undercarriage. In some examples, the pivot device 106 can allow the upper frame to rotate 360° with respect to the undercarriage.

The vehicle 100 can include a boom 108. The boom 108 can be positioned adjacent to or in front of the interior portion 102. The boom 108 can be controlled by one or more hydraulic cylinders 110. For example, an operator of the vehicle 100 can use the control system to operate the hydraulic cylinder 110, which can in turn move the boom 108. In some examples, the boom 108 can include a dipper stick or arm 112. The arm 112 can be controlled by one or more hydraulic cylinders 114. For example, the vehicle operator can use the control system to operate the hydraulic cylinder 114, which can in turn move the arm 112. In some examples, a bucket 118 (e.g., an excavator bucket) can be positioned at an end of the arm 112. The bucket 118 can be movable with respect to the arm 112. For example, the bucket 118 can be pivotable with respect to the arm 112. The bucket 118 can be controlled by one or more hydraulic cylinders 116. For example, the vehicle operator can use the control system to operate the hydraulic cylinder 116, which can in turn move the bucket 118.

In some examples, the vehicle 100 can include a counterweight 120 for offsetting a load. The load can include, for example, a material positioned in the bucket 118. In some examples, the counterweight 120 can help balance the vehicle 100 as the vehicle 100 gathers the load.

The vehicle 100 can include an engine 122. The engine 122 can control operation of the movement device 104. For example, the engine 122 can provide energy for moving a track of the movement device 104. The engine 122 can be controlled by the control system positioned in the interior portion 102. For example, a vehicle operator can use the control system to operate the engine 122 for moving the vehicle 100 in one or more directions.

The vehicle 100 also includes a fluid-flow control system 124. The fluid-flow control system 124 can be for directing a fluid in a particular direction. The fluid can include a gas (e.g., air), a liquid, or both. In some examples, the fluid-flow control system 124 can be a cooling system for cooling the engine 122, the interior portion 102, or another component or area of the vehicle 100.

Figure 2:
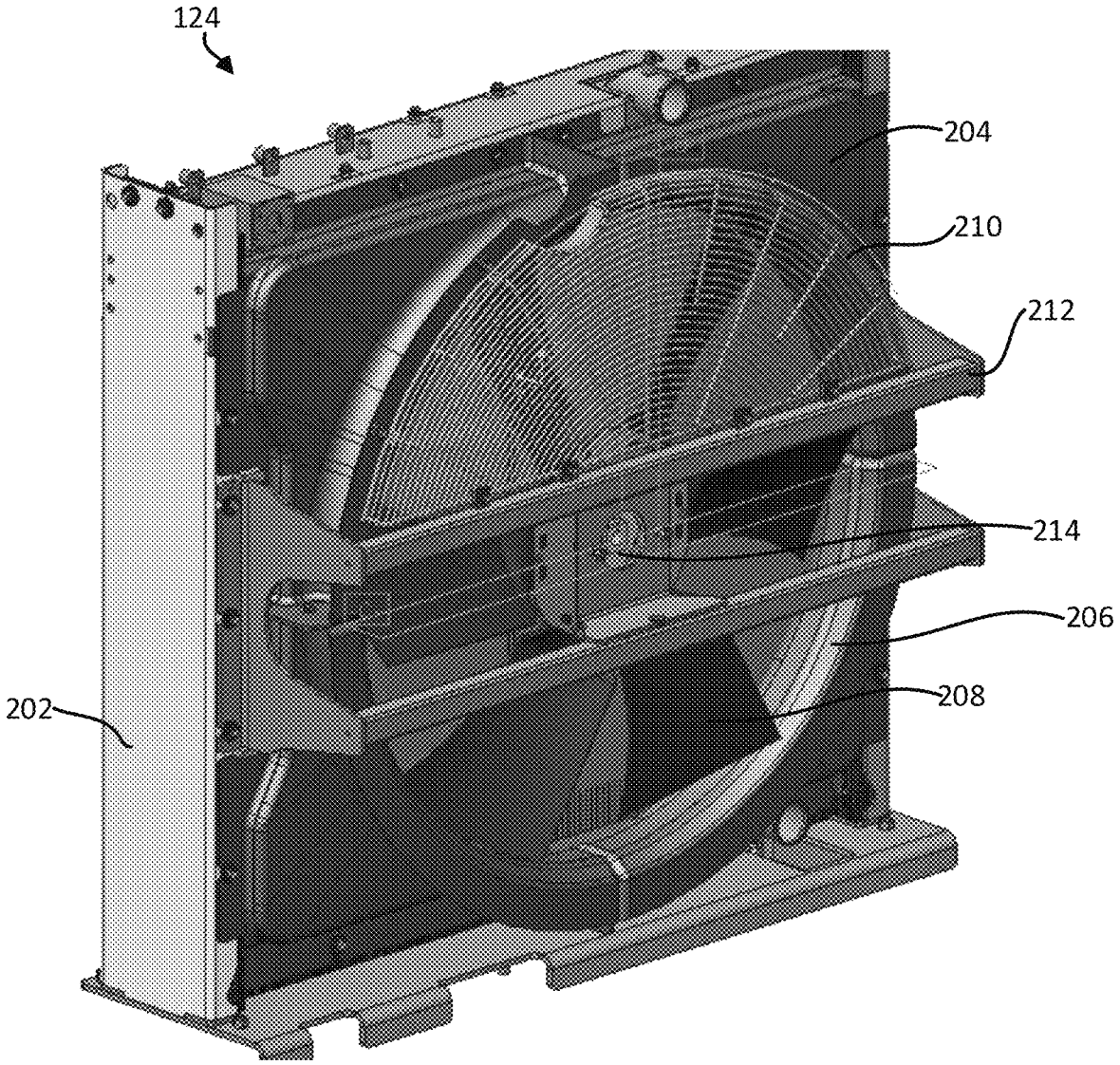
FIG. 2 is a perspective view of an example of a fluid-flow control system according to some aspects.

An example of the fluid-flow control system 124 is shown in FIG. 2. In this example, the fluid-flow control system 124 includes an outer housing 202 within which a component, such as a radiator, can be positioned. A cover plate 204 can be positioned overtop of the component(s) to at least partially enclose the component(s) within the outer housing 202.

In some examples, the cover plate 204 can also have an opening 206 for a fan 208. The fan 208 can be positioned in the opening 206 and capable of rotating about a central axis. In some examples, a grating 210 can be positioned over at least a portion of the fan 208 to protect the fan 208 and prevent injury. In some examples, one or more supports 212 can extend from one end of the outer housing 202 to another end of the outer housing 202. The support(s) 212 can maintain the grating 210, the fan 208, or both in a particular position.

The fan 208 can be coupled to a hub 214 via one or more mounting components. For example, the fan 208 can be mounted to the hub 214 via screws, nails, bolts, or any combination of these. This can enable the fan 208 to move in unison with the hub 214. In some examples, the hub 214 can be rotated by a shaft (not shown), which can be connected to a motor, such as a hydraulic engine. As the motor rotates the shaft, the shaft can rotate the hub 214 and thus the fan 208.

Figure 3:
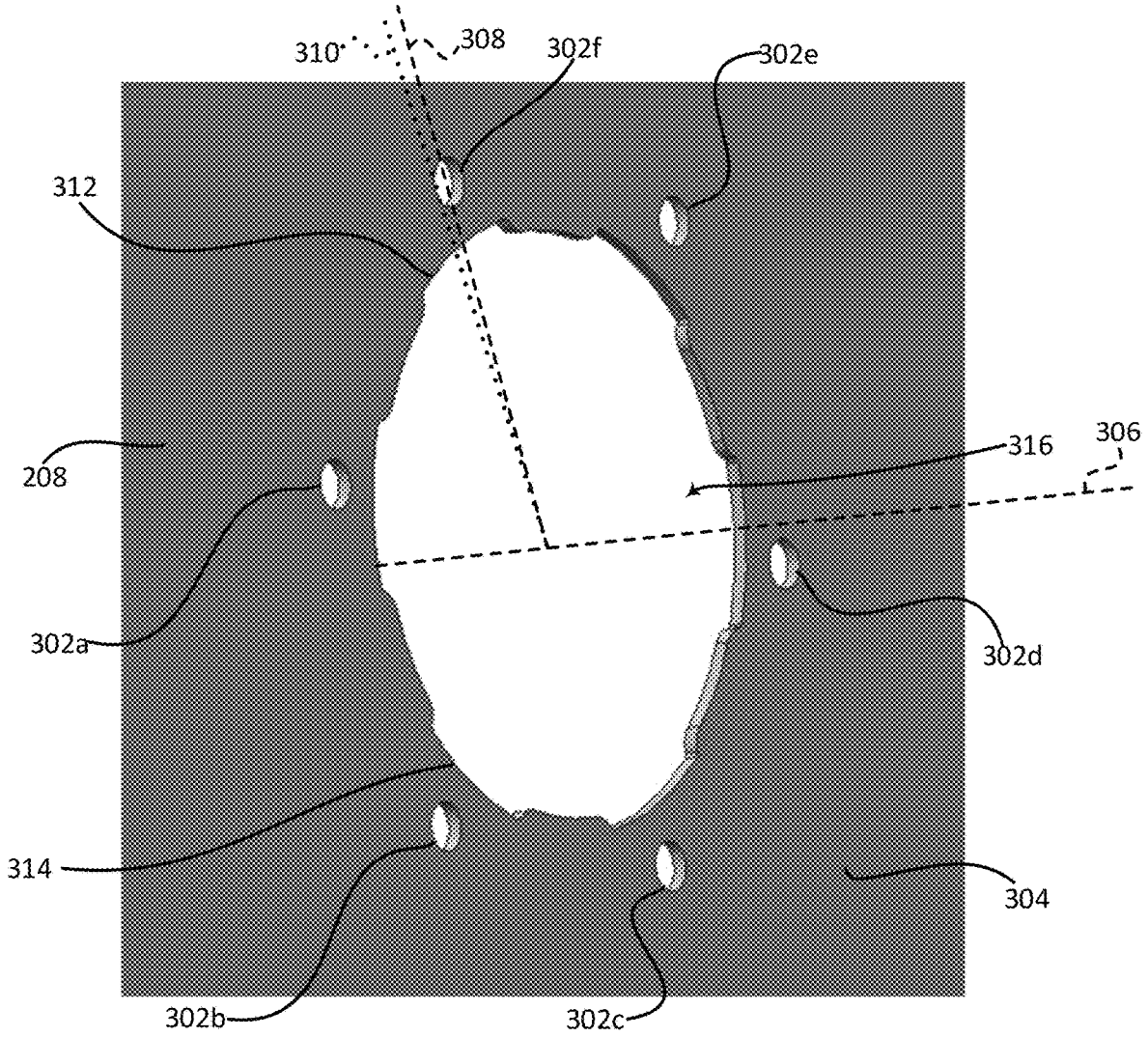
FIG. 3 is a perspective view of an example of a portion of a fan according to some aspects.

FIG. 3 is a perspective view of an example of a portion of a fan 208 according to some aspects. The fan 208 includes multiple openings 302*a-f* through an interface surface 304 of the fan 208. In this example, there are six openings 302*a-f*. But in other examples, the interface surface 304 can include any number and combination of openings. The openings 302*a-f* can be equidistantly spaced or non-equidistantly spaced about a central axis 306 of the fan 208. The openings 302*a-f* can have any suitable shape, such as a circular shape, square shape, rectangular shape, triangle shape, oval shape, or any combination of these.

The fan 208 can have an interior cutout 316 around the central axis 306 of the interface surface 304. The interior cutout 316 can be for receiving a raised surface of a hub, such as hub 214 of FIG. 2. In some examples, the interior cutout 316 can have a keyholes 314 for receiving corresponding keys on a raised surface of the hub. Each of the keyholes 314 may cooperate with a corresponding key on the hub. In some examples, the interior cutout 316 can have as many keyholes 314 as there are openings in the interface surface 304. For example, the interior cutout 316 can have six keyholes 314 and the interface surface 304 can have six openings 302. In other examples, the interior cutout 316 can include more or fewer keyholes 314. The keyholes 314 can have any suitable configurations (e.g., shapes, sizes, orientations, locations, or any combination of these).

Each of the openings 302*a-f* in the interface surface 304 has a central point. For example, axis 308 extends through the central point of opening 302*f* in the interface surface 304. And each of the keyholes has a central point. For example, axis 310 extends through a central point along a perimeter 312 of a keyhole that corresponds to (e.g., is most proximate to) opening 302*f*. In some examples, the central point of the opening 302*f* is offset from the central point of the corresponding keyhole. In FIG. 3, the central point of the opening 302*f* is offset from the central point of the corresponding keyhole by an angle (e.g., 5 degrees) formed between axis 308 and axis 310. This can enable the hub to fit into the interior cutout 316 and align with the openings 302*a-f* if the fan 208 is facing a desired direction, but not if the fan 208 is facing the opposite direction.

Figure 4:
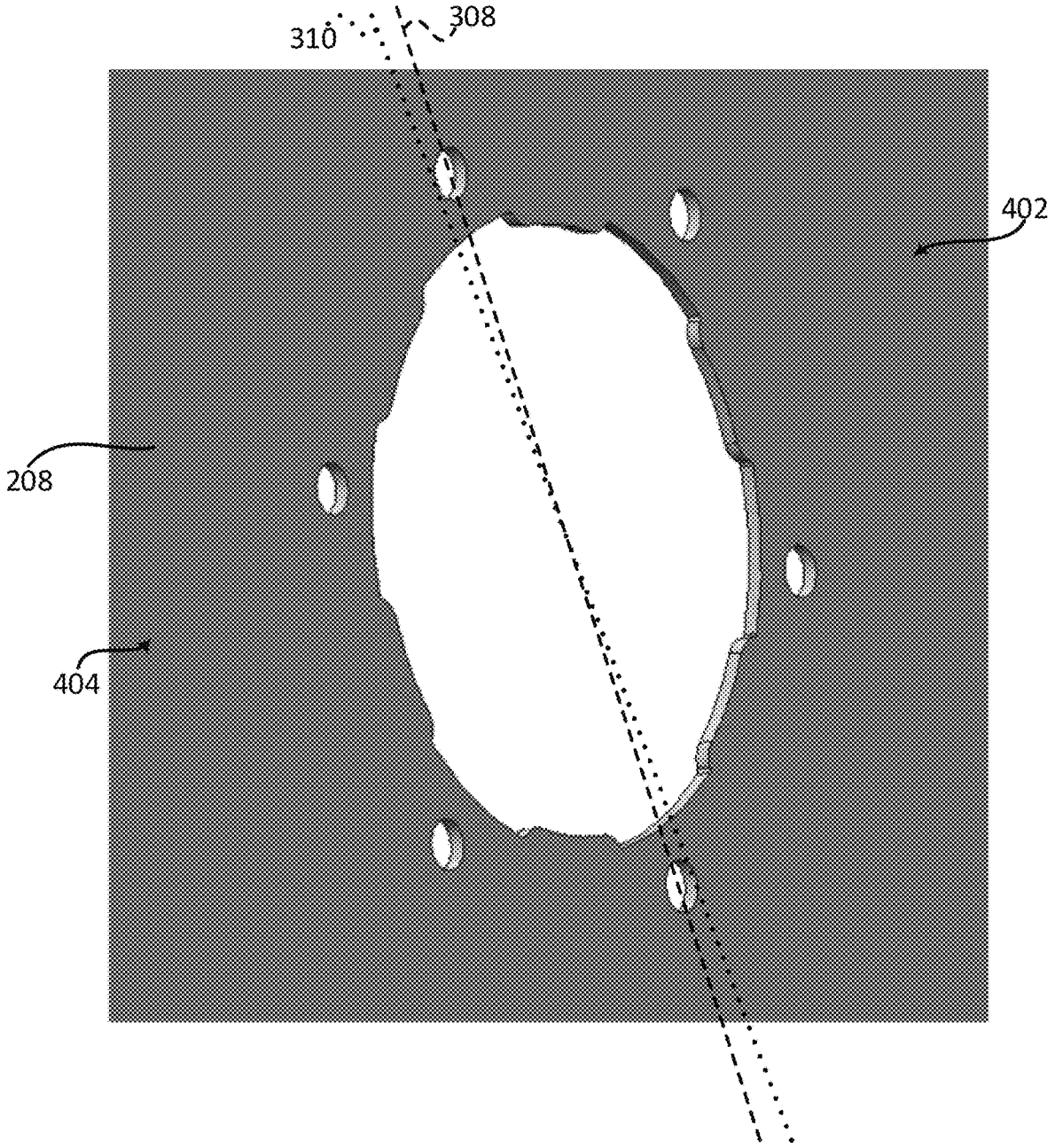
FIG. 4 is a perspective view of an example of a portion of a fan according to some aspects.

Referring now to FIG. 4, in some examples, the axis 308 can be an axis of symmetry for the openings (e.g., openings 302*a-f* of FIG. 3). For example, the axis 308 can divide the fan 208 into two halves 402, 404 having openings that are arranged symmetrically to one another. But the arrangement of the keyholes may not be arranged symmetrically to one another on either side of axis 308. Additionally or alternatively, axis 310 can be another axis of symmetry for the keyholes (e.g., keyholes 314 of FIG. 3). The axis 310 can divide the fan 208 into two halves 402, 404 having keyholes that are arranged symmetrically to one another. But the arrangement of the openings may not be arranged symmetrically to one another on either side of axis 310. This is because the axis 310 is offset from axis 308 by a predetermined amount, such as 3 degrees. Offsetting the axis of symmetry for the openings from the axis of symmetry for the keyholes can enable the hub to fit into the interior cutout of the fan, and align with the fan's openings, only if the fan is facing a desired direction.

Figure 5:
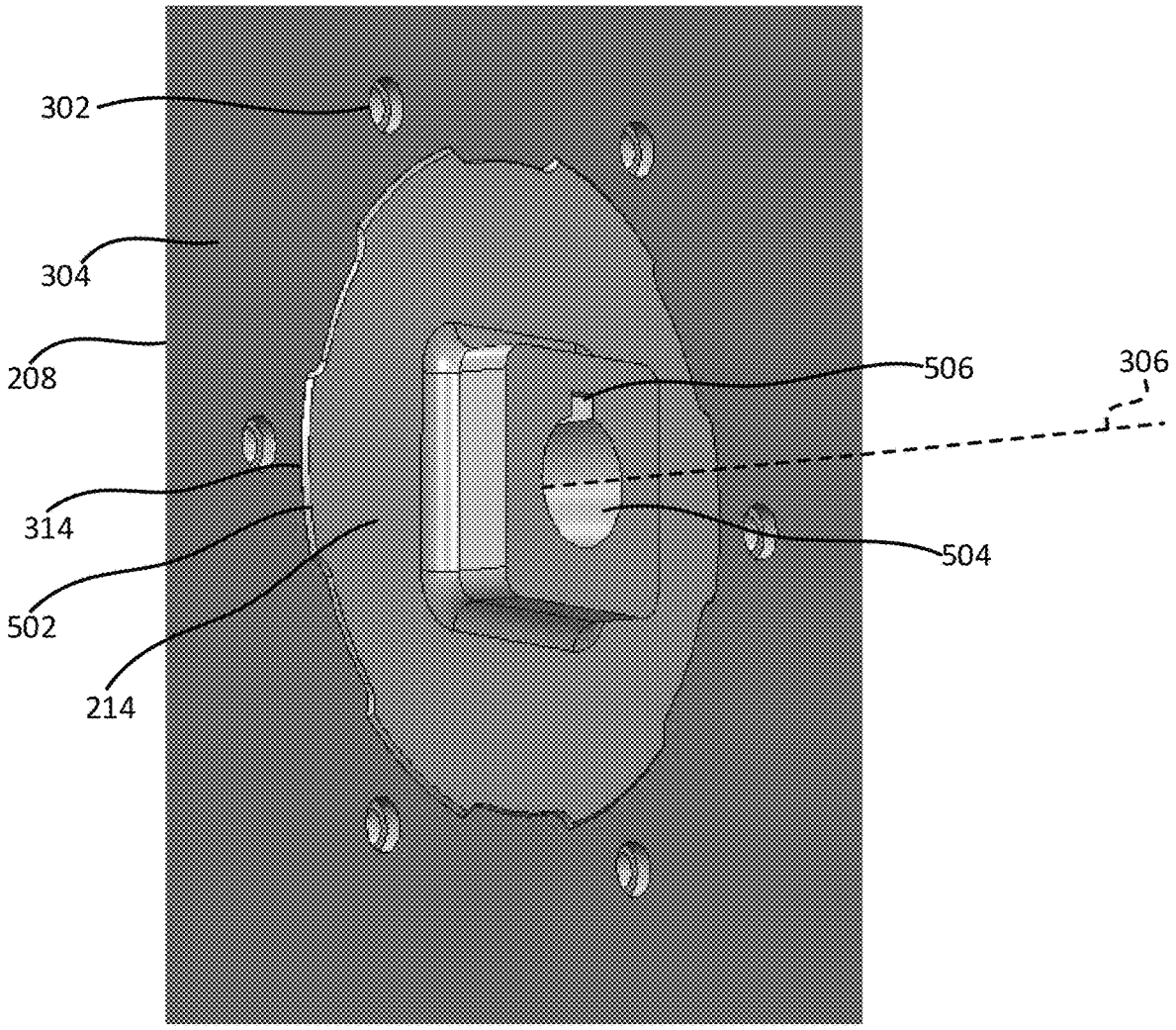
FIG. 5 is a perspective view of an example of a hub positioned to couple with a fan according to some aspects.

FIG. 5 is a perspective view of an example of a hub 214 positioned to couple with a fan 208 according to some aspects. The hub 214 has a profile with keys 502 extending radially outwardly. The keys 502 are positioned within (e.g., inserted into) the keyholes 314 of the fan 208. In some examples, the keys 502 may only be positionable within the keyholes 314 if the fan 208 is oriented correctly (e.g., facing a desired direction).

The openings 302 in the interface surface 304 of the fan 208 are also aligned with openings in the hub 214. The openings 302 in the interface surface 304 of the fan 208 may only align with the openings in the hub 214 when the fan 208 is oriented correctly. By aligning the openings 302 of the fan 208 with the openings of the hub 214, mounting components can be inserted through the openings 302 in the fan 208 and into corresponding openings of the hub 214 to mount the fan 208 to the hub 214.

The hub 214 can include a central opening 504 formed around a central axis 306 of the hub 214. The central opening 504 can be for receiving a shaft. In some examples, the shaft can have a protrusion that fits into a slot 506 cut radially outwardly from the central opening 504. This can enable the hub 214 to rotate in unison with the shaft. In other examples, the shaft can have a slot for receiving a protrusion extending radially inwardly from the central opening 504, thereby enabling the shaft and the hub 214 to rotate in unison. In still other examples, the hub 214 can be glued, welded, screwed, or otherwise coupled to the shaft to enable the shaft and the hub 214 to rotate in unison. The shaft can be coupled to a motor, which can rotate the shaft and thus the hub and fan.

Figure 6:
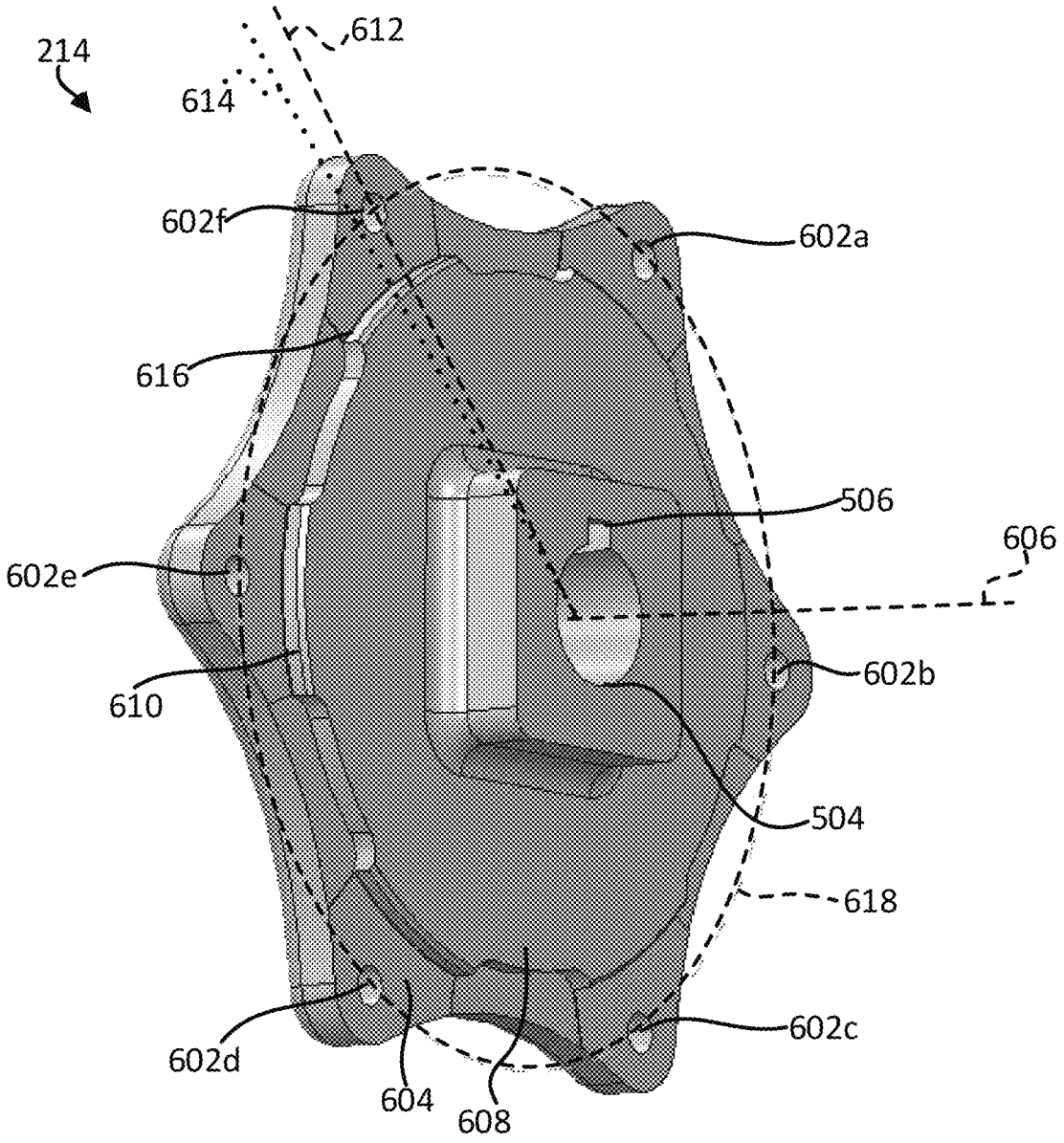
FIG. 6 is a perspective view of an example of a hub according to some aspects.

FIG. 6 is a perspective view of an example of a hub 214 according to some aspects. The hub 214 includes multiple openings 602*a-f* through an interface surface 604 of the hub 214. In this example, there are six openings 602*a-f*. But in other examples, the interface surface 604 can include any number and combination of openings. The openings 602*a-f* can be equidistantly spaced or non-equidistantly spaced about a central axis 606 of the hub 214. For example, the openings 602*a-f* can be equidistantly spaced around a circumference of the dashed circle 618. The openings 602*a-f* can have any suitable shapes, such as circular shapes, square shapes, rectangular shapes, triangle shapes, oval shapes, or any combination of these.

The hub 214 can have a raised surface 608 that is formed around the central axis 606 of the interface surface 604. The raised surface 608 can fit into an interior cutout of a fan, such as fan 208 of FIG. 2. For example, the raised surface 608 can have a keys 610 that are positionable within corresponding keyholes of the interior cutout of the fan. Each of the keys 610 may cooperate with a corresponding keyhole on the fan. In some examples, the raised surface 608 has as many keys 610 as there are openings in the interface surface 604. For example, the raised surface 608 can have six keys 610 and the interface surface 604 can have six openings 602. In other examples, the raised surface 608 can include more or fewer key 610. The keys 610 can have any suitable configurations.

Each of the openings 602*a-f* in the interface surface 604 has a central point. For example, axis 612 extends through the central point of opening 602*f* in the interface surface 604. And each of the keys 610 has a central point. For example, axis 614 extends through a central point along a perimeter 616 of a key that corresponds to opening 602*f*. In some examples, the central point of the opening 602*f* is offset from the central point of the corresponding key. For example, the opening 602*f* can have a central point that is offset from the central point of the corresponding key by an angle (e.g., 3 degrees) between axis 612 and axis 614. This can enable the hub 214 to fit into an interior cutout of a fan and align with the fan's openings only if the fan is oriented correctly.

In some examples, the axis 612 can be an axis of symmetry for the openings 602*a-f*. For example, the axis 612 can divide the hub 214 into two halves in which the openings 602*a-f* are arranged symmetrically to one another. But the arrangement of the keys 610 may not be arranged symmetrically to one another on either side of axis 612. In some examples, the axis 614 can be another axis of symmetry for the keys 610. The axis 614 can divide the hub 214 into two halves in which the keys 610 that are arranged symmetrically to one another. This is because axis 612 is offset from axis 614 by a predetermined amount, such as 3 degrees. Offsetting the axis of symmetry for openings 602*a-f* from the axis of symmetry for the keys 610 can enable the hub 214 to fit into an interior cutout of a fan and align with the fan's openings only if the fan is oriented correctly.

Figure 7:
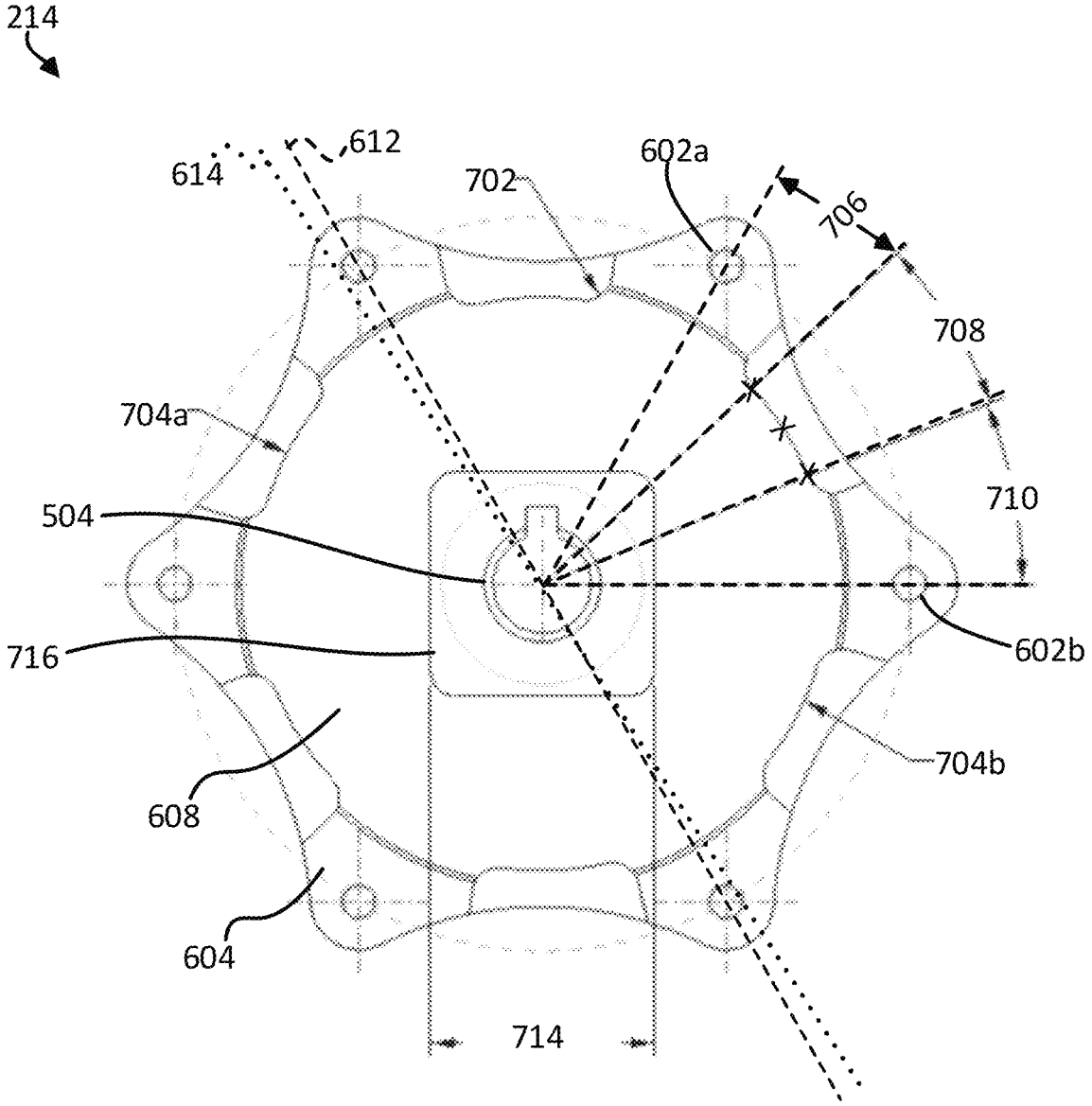
FIG. 7 is a top view of an example of a hub according to some aspects.

FIG. 7 is a top view of an example of a hub 214 according to some aspects. The hub 214 includes multiple keys positioned around a profile of a raised surface 608 of the hub 214. Between the keys can be recessed areas, such as recessed areas 704*a-b*. The recessed areas can receive protrusions extending radially inwardly from, and defining a perimeter of, an interior cutout of a fan. Thus, the recessed areas can also be referred to as keyholes and the protrusions can also be referred to as keys. In some examples, the recessed areas can have curved edges, such as edge 702, which may be formed at least in part using a drill, a press, or another rounded tool. In other examples, the recessed areas can have linear edges. The recessed areas can have any suitable configuration.

The keys can be arranged symmetrically around axis 614 (but not axis 612) and the openings can be arranged symmetrically around axis 612 (but not axis 614). This can result in angle 706 being different from angle 710. For example, angle 706 can be 21 degrees and angle 710 can be 22 degrees. Angle 706 can define the angle between a central point of opening 602*a* and a first point in a recessed area between openings 602*a-b*. The first point is indicated by the "X" symbol closest to the opening 602*a*. And angle 710 can define another angle between a central point of opening 602*b* and a second point in the recessed area between openings 602*a-b*. The second point is indicated by the "X" symbol closest to the opening 602*b*. In some examples, the first point and the second point are equidistant from a central point of the recessed area. The central point is indicated by the "X" symbol between the first point and the second point. The angle between the first point and the second point can be angle 708. Angle 708 can be any suitable angle, for example, 21 degrees or 22 degrees.

The hub 214 can include a central opening 504 for receiving a shaft. In some examples, the central opening 504 can be formed through a raised central portion 716 of the hub 214. The raised central portion 716 can be positioned around a central axis (e.g., central axis 606) of the hub 214. The raised central portion 716 can have a perimeter with any suitable shape, such as a square shape, oval shape, rectangular shape, circular shape, or any combination of these. In this example, the raised central portion 716 has a perimeter that forms a substantially square shape with four edges. A length 714 of an edge of the perimeter can be, for example, between 30 millimeters (mm) and 50 mm.

Figure 8:
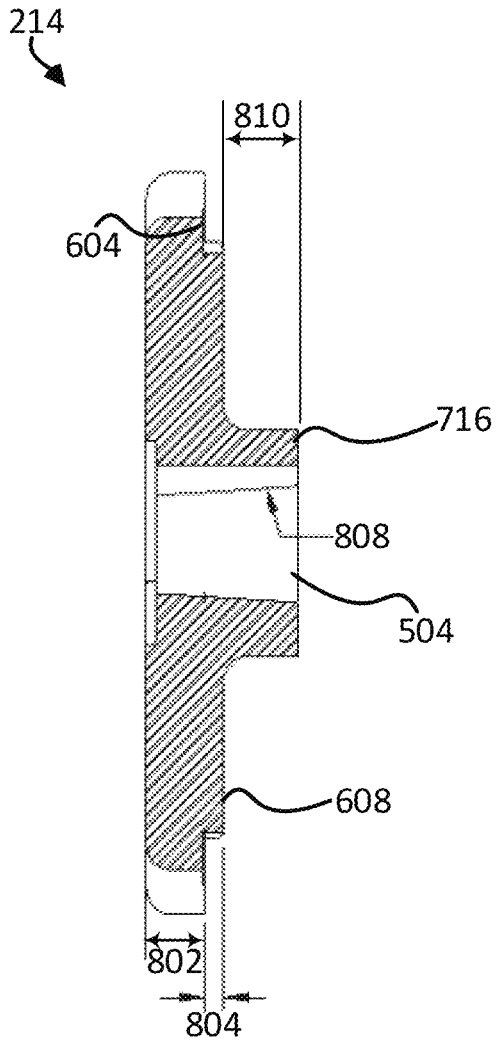
FIG. 8 is a cross-sectional side view of an example of a hub according to some aspects.

FIG. 8 is a cross-sectional side view of an example of a hub 214 according to some aspects. The hub 214 can include an interface surface 604 and a raised surface 608. The thickness 802 of the interface surface can be any suitable amount, such as between 5 mm and 10 mm. The thickness 804 of the raised surface 608 can also be any suitable amount, such as between 1 mm and 5 mm. In some examples, the thickness 804 of the raised surface 608 can be any suitable size to make it readily apparent to a worker that the worker is attempting to mount a fan to the hub 214 in the wrong direction. For example, if the fan is oriented backwards, the keys around the raised surface 608 of the hub 214 may prevent the raised surface 608 from being positioning in the interior cutout of the fan, creating a gap between the interface surface 604 of the hub 214 and a corresponding interface surface of the fan. The gap will be the same size as the thickness 804 of the raised surface 608. So, the thicker the raised surface 608, the larger the gap will be, making it more visually apparent that the worker is attempting to mount a fan to the hub 214 in the wrong direction.

The hub 214 may also include a raised central portion 716 with a central opening 504. A thickness 810 of the raised central portion 716 can be any suitable amount, such as between 15 mm and 25 mm. In some examples, the central opening 504 can have an interior wall 808 that tapers in thickness. The interior wall 808 can taper in thickness at any suitable angle, such as at between 10 degrees and 15 degrees from horizontal. The interior wall 808 can mate with a corresponding tapered end of a shaft to at least partially couple the hub 214 to the shaft.

Figure 9:
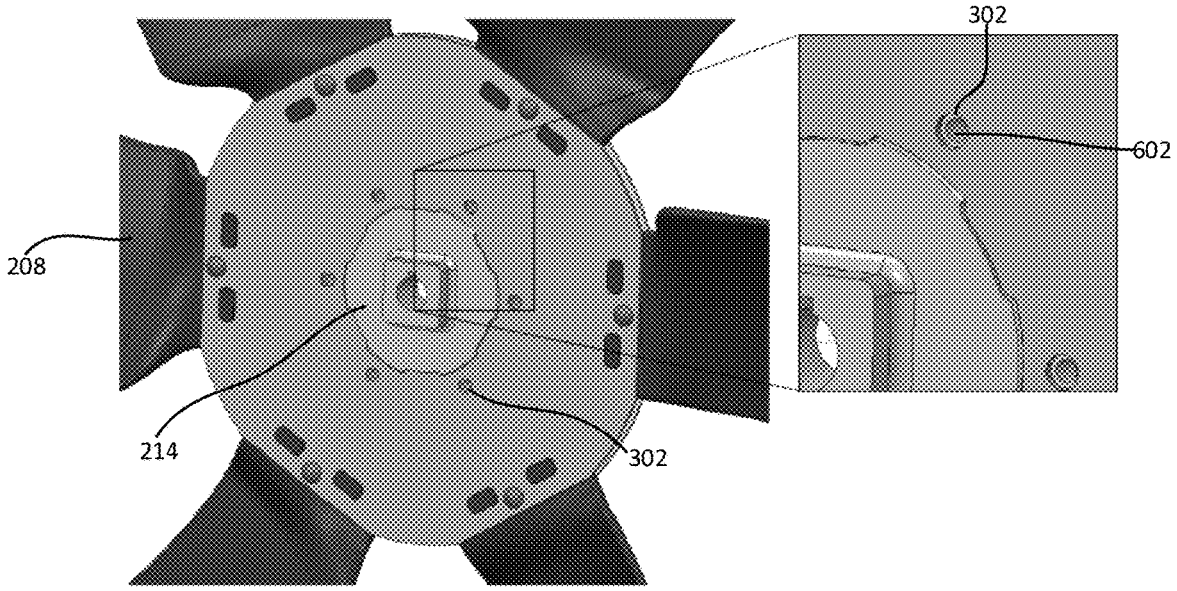
FIG. 9 is a magnified view of an example of openings of a fan aligned with openings of a hub according to some aspects.
Figure 10:
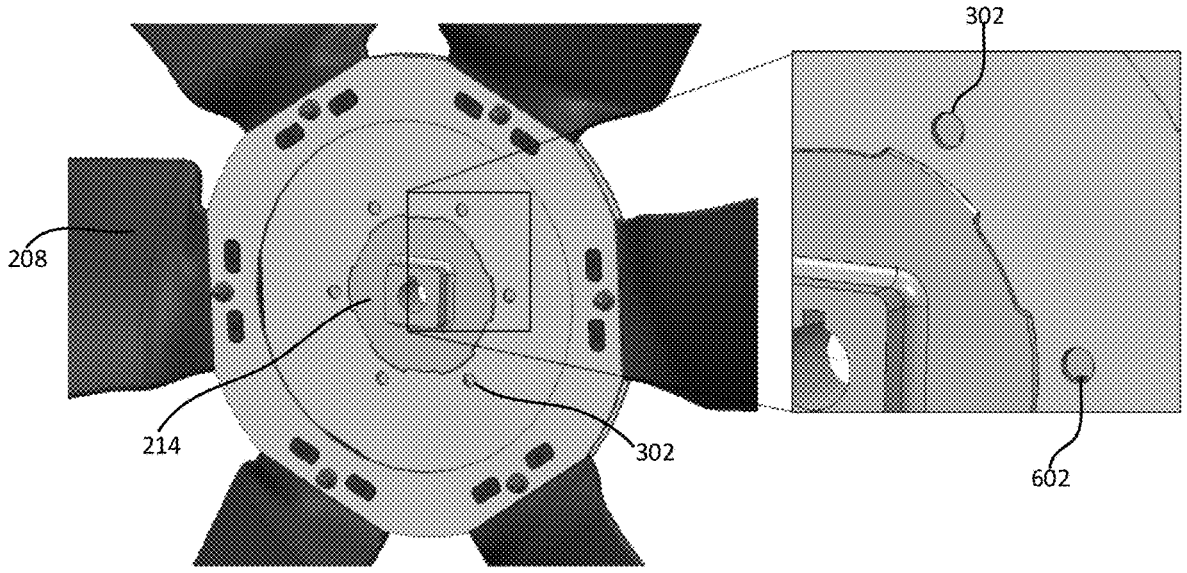
FIG. 10 is a magnified view of an example of openings of a fan misaligned with openings of a hub according to some aspects.

FIG. 9 shows a magnified view of an example of openings 302 of a fan 208 aligned with openings 602 of a hub 214 according to some aspects. If the fan 208 is oriented correctly, the hub 214 can be inserted into the interior cutout of the fan 208 and the openings 302 of the fan 208 will align with the openings 602 of the hub 214. The fan 208 can then be mounted to the hub 214 using mounting components. If the fan 208 is oriented incorrectly, the hub 214 may not be capable of being inserted into the interior cutout of the fan 208, the openings 302 of the fan 208 may not align with the openings 602 of the hub 214, or both. An example of this is shown in FIG. 10.

Figure 11:
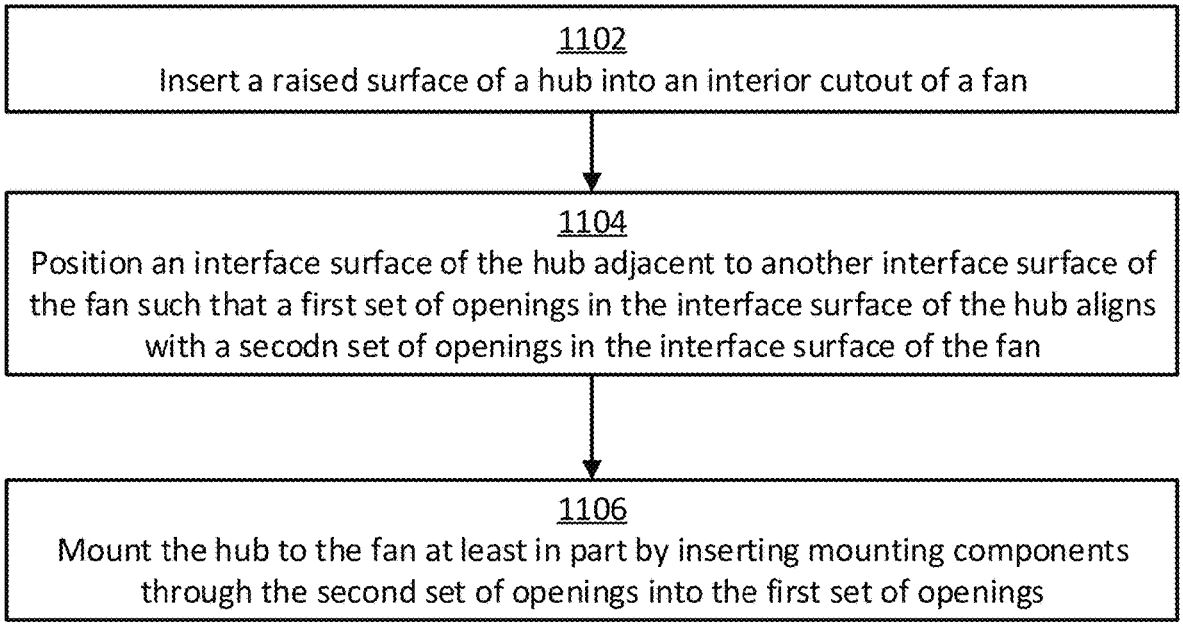
FIG. 11 is a flow chart of an example of a process for coupling a hub to a fan according to some aspects.

FIG. 11 is a flow chart of an example of a process for coupling a hub to a fan according to some aspects. In other examples, the process can include more steps, fewer steps, or a different combination of the steps shown in FIG. 11. The steps below are described with reference to the components discussed above.

In block 1102, a raised surface 608 of a hub 214 is inserted into an interior cutout 316 of a fan 208. The raised surface 608 can be inserted such that at least two keys 610 defined by a profile (e.g., an outer profile) of the raised surface 608 of the hub 214 are received by at least two keyholes 314 defined by the interior cutout 316 of the fan 208.

In block 1104, an interface surface 604 of the hub 214 is positioned adjacent to another interface surface 304 of the fan 208. The interface surface 604 of the hub 214 can be positioned adjacent to the other interface surface 304 of the fan 208 such that a first set of openings 602 in the interface surface 604 of the hub 214 aligns with a second set of openings 302 in the other interface surface 304 of the fan 208.

In block 1106, the hub 214 is mounted to the fan 208 at least in part by inserting mounting components through the second set of openings 302 into the first set of openings 602. For example, the hub 214 can be mounted to the fan 208 by inserting screws or bolts through the second set of openings 302 in the fan 208 and into the first set of openings 602 in the hub 214. The screws or bolts can then be tightened to couple the hub 214 to the fan 208.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure. For instance, any example(s) described herein can be combined with any other example(s).

The invention claimed is:

1. A hub comprising:

a first interface surface configured to be positioned adjacent to a second interface surface of a fan, the first interface surface having a first plurality of openings positioned to (i) align with a second plurality of openings in the second interface surface of the fan when a first side of the first interface surface is positioned adjacent to the second interface surface and (ii) misalign with the second plurality of openings when a second side of the first interface surface is positioned adjacent to the second interface surface, the second side being opposite to the first side, and the first plurality of openings being configured to receive mounting components for coupling the hub to the fan; and a raised surface protruding from the first interface surface of the hub and having a diameter that is smaller than an external diameter of the first interface surface of the hub the raised surface having a profile with at least two keys configured to be received in corresponding keyholes of the second interface surface of the fan, wherein each opening in the first plurality of openings of the first interface surface has a central point that is offset from another central point of a respective key among the at least two keys of the raised surface.

2. The hub of claim 1, wherein the first interface surface of the hub has a first axis of symmetry that is offset from a second axis of symmetry of the raised surface of the hub.

3. The hub of claim 1, wherein the raised surface has a number of keys that corresponds to a number of openings forming the first plurality of openings in the first interface surface of the hub.

4. The hub of claim 1, wherein the openings in the first plurality of openings are equidistantly spaced around a central axis of the hub.

5. The hub of claim 4, wherein the at least two keys are equidistantly spaced around the central axis of the hub.

6. The hub of claim 1, wherein the hub couples the fan to a shaft, and wherein the shaft is coupled to a motor for rotating the fan.

7. The hub of claim 6, wherein the fan, hub, shaft, and motor are positioned in a vehicle.

8. The hub of claim 1, further comprising a raised central portion that protrudes from the raised surface, the raised central portion being positioned about a central axis of the hub, the raised central portion having a central opening for receiving a shaft for a motor.

9. A fan comprising:

a first interface surface configured to be positioned adjacent to a second interface surface of a hub, the first interface surface having a first plurality of openings positioned to (i) align with a second plurality of openings in the hub when a first side of the first interface surface is positioned adjacent to the second interface surface of the hub and (ii) misalign with the second plurality of openings when a second side of the first interface surface is positioned adjacent to the second interface surface of the hub, the second side being opposite to the first side, and the first plurality of openings being configured to receive mounting components for coupling the hub to the fan; and an interior cutout that has at least two keyholes configured to receive corresponding keys of the second interface surface of the hub;

wherein each opening among the first plurality of openings in the first interface surface has a central point that is offset from another central point of respective keyhole among the at least two keyholes of the interior cutout.

10. The fan of claim 9, wherein the first plurality of openings are arranged to have a first axis of symmetry, the at least two keyholes are arranged to have a second axis of symmetry, and the first axis of symmetry is offset from the second axis of symmetry.

11. The fan of claim 9, wherein a number of keyholes forming the at least two keyholes corresponds to a number of openings forming the first plurality of openings in the first interface surface of the fan.

12. The fan of claim 9, wherein the openings in the first plurality of openings are equidistantly spaced around a central axis of the fan.

13. The fan of claim 9, wherein the at least two keyholes are equidistantly spaced around a central axis of the fan.

14. The fan of claim 9, wherein the hub is configured to couple the fan to a shaft.

15. The fan of claim 14, wherein the fan is coupled to the shaft by the hub, and wherein the shaft is coupled to a motor in a vehicle for rotating the fan.

16. The fan of claim 9, wherein the fan is configured to direct fluid flow in a same direction in response to both (i) the first side of the fan being positioned adjacent to the second interface surface of the hub, and (ii) the second side of the fan being positioned adjacent to the second interface surface of the hub.

17. A method of coupling a hub to a fan, the method comprising:

inserting a raised surface of the hub into an interior cutout of the fan such that at least two keys defined by a profile of the raised surface of the hub are received by at least two keyholes defined by the interior cutout of the fan;

positioning a first interface surface of the hub adjacent to a second interface surface of the fan such that a first plurality of openings in the first interface surface of the hub aligns with a second plurality of openings in the second interface surface of the fan, the first plurality of openings being positioned to (i) align with the second plurality of openings when a first side of the second interface surface is positioned adjacent to the first interface surface and (ii) misalign with the second plurality of openings when a second side of the second interface surface is positioned adjacent to the first interface surface, the second side being opposite to the first side, wherein the raised surface of the hub protrudes from the first interface surface of the hub and has a diameter that is smaller than an external diameter of the first interface surface of the hub; and mounting the hub to the fan at least in part by inserting mounting components through the second plurality of openings into the first plurality of openings.

18. The method of claim 17, wherein each opening in the first plurality of openings of the first interface surface of the hub has a central point that is offset from another central point of a respective key of the at least two keys of the raised surface.

19. A hub comprising:

a first interface surface configured to be positioned adjacent to a second interface surface of a fan, the first interface surface having a first plurality of openings positioned to align with a second plurality of openings in the second interface surface of the fan and through which mounting components are receivable for coupling the hub to the fan;

a raised surface protruding from the first interface surface of the hub, the raised surface having a diameter that is smaller than an external diameter of the first interface surface of the hub, and the raised surface having a profile with at least two keys configured to be received in corresponding keyholes of the second interface surface of the fan; and a raised central portion protruding from the raised surface, the raised central portion being positioned about a central axis of the hub, the raised central portion having a central opening for receiving a shaft for a motor;

wherein each opening in the first plurality of openings of the first interface surface has a central point that is offset from another central point of a respective key among the at least two keys of the raised surface.

20. The hub of claim 19, wherein the hub is coupled to the fan in a vehicle.

* * * * *